US008171942B2

(12) United States Patent
Poran

(10) Patent No.: US 8,171,942 B2
(45) Date of Patent: May 8, 2012

(54) APPARATUS FOR RECEIVING INTERCHANGEABLE GROOMING UNITS

(75) Inventor: Yehuda Poran, Kibbutz El-Rom (IL)

(73) Assignee: Epilady 2000 LLC, Dover, Kent, DE (US)

( * ) Notice: Subject to any disclaimer, the term of this patent is extended or adjusted under 35 U.S.C. 154(b) by 456 days.

(21) Appl. No.: 11/574,073

(22) PCT Filed: Sep. 6, 2004

(86) PCT No.: PCT/IB2004/003023

§ 371 (c)(1), (2), (4) Date: Feb. 22, 2007

(87) PCT Pub. No.: WO2006/027641

PCT Pub. Date: Mar. 16, 2006

(65) Prior Publication Data

US 2007/0270883 A1 Nov. 22, 2007

(51) Int. Cl.
*A45D 29/05* (2006.01)

(52) U.S. Cl. ..... 132/75.8

(58) Field of Classification Search ..... 132/75.8; 606/133; 30/30, 43.7, 43, 42, 532
See application file for complete search history.

(56) References Cited

U.S. PATENT DOCUMENTS

| | | | | |
|---|---|---|---|---|
| 3,260,542 | A * | 7/1966 | Di Milla | 403/356 |
| 3,747,594 | A * | 7/1973 | Bishop | 601/93 |
| 4,030,573 | A * | 6/1977 | Buzzi et al. | 188/380 |
| 5,611,804 | A | 3/1997 | Heintke et al. | |
| 6,277,129 | B1 | 8/2001 | Poran | |
| 2002/0054723 | A1 * | 5/2002 | Fuchida et al. | 384/564 |
| 2003/0102002 | A1 * | 6/2003 | Cho | 132/73.6 |
| 2005/0005453 | A1 * | 1/2005 | Egeresi | 30/34.1 |

FOREIGN PATENT DOCUMENTS

| | | | |
|---|---|---|---|
| CH | 662 302 | | 9/1987 |
| EP | 0 408 095 | | 1/1991 |
| WO | WO 03/079845 | | 10/2003 |
| WO | WO 03079845 | * | 10/2003 |
| WO | WO03079845 | * | 10/2003 |
| WO | WO 03079845 A2 | * | 10/2003 |

OTHER PUBLICATIONS

Search Report issued in International Patent Application No. PCT/IB2004/003023 on Jun. 20, 2005.

* cited by examiner

*Primary Examiner* — Rachel Steitz
*Assistant Examiner* — Brianne Kalach
(74) *Attorney, Agent, or Firm* — Stein McEwen, LLP

(57) ABSTRACT

An apparatus for receiving operationally powering units interchangeable grooming units. The apparatus comprising a casing, a motor, attachment means for allowing the grooming units to be releasably attached to the casing and mounting means for allowing the grooming units to be driven by the motor. The mounting means comprise a shaft with an end portion having a protrusion located eccentrically on the end portion. The mounting means are adapted to enable the grooming units with accordingly adapted receiving means to carry out a rotational movement and/or a linear movement without gear arrangements in the receiving means of the grooming unit.

27 Claims, 6 Drawing Sheets

APPARATUS FOR RECEIVING INTERCHANGEABLE GROOMING UNITS

CROSS-REFERENCE TO RELATED APPLICATION

This application claims the benefit of PCT International Patent Application No. PCT/IB2004/003023, filed Sep. 6, 2004, in the International Bureau, the disclosures of which are incorporated herein by reference.

BACKGROUND OF THE INVENTION

1. Field of the Invention

The present invention relates generally to an apparatus for receiving interchangeable grooming units e.g. epilation means and depilation means for removing body hair.

2. Description of the Related Art

Commonly, apparatus for the removal of body hairs are either provided with an epilating cylinder for plucking body hair or alternatively with a depilation means for cutting body hair.

Said means for removing hair are normally adapted to be driven by a gear arrangement wherein a depilating means executes a reciprocating motion in alternate directions relative to an inner cutter and wherein an epilating means such as an epilating cylinder executes rotary movement.

Further in the prior art apparatuses for removing body hair are known in which the function of epilating and of depilating hair from the skin of a user are provided in a single apparatus.

For example U.S. Pat. No. 6,277,129 discloses a dual ended hair remover wherein epilating and depilating heads are provided at opposite ends of said hair remover. Said hair remover comprises a motor and a gear arrangement which cause a shaving element to move reciprocating in alternating directions relative to a fixed element and rotates an epilating cylinder simultaneously with the shaving element while either the depilating head or the epilating head is covered by a handle.

In U.S. Pat. No. 5,611,804 an appliance for the removal of body hair is disclosed which is adapted to receive a first attachment incorporating an epilating cylinder or alternatively a second attachment incorporating a long hair trimmer. The attachment incorporating the long hair trimmer includes a blade or an outer cutter adapted to be driven by a gear arrangement and performing an oscillating motion relative to an inner cutter. The gear arrangement includes a crown gear which is adapted to be driven by a driving gear and which meshes with a pinion provided with an eccentrically arranged engaging means coupled to the blade. In case the epilation head is attached to the hair remover the epilating cylinder is coupled to the driving gear and with the motor turned on rotates about its longitudinal axis or also oscillates.

Said hair removers as described in the prior art have the disadvantage that they have a complicated structure which requires additional space. Further the hair removers are expensive in manufacturing. Moreover, they are neither intended nor suitable to carry out other operations than removing body hair by epilation or depilation.

Further, the grooming units of the prior art have the disadvantage that they are either fixedly secured to a hair removal device and/or comprise a complicated structure which requires additional space.

SUMMARY OF THE INVENTION

The object of the present invention is therefore to provide an apparatus which can be manufactured at low costs and which can be provided with a plurality of different grooming units without requiring additional space. This object is achieved by the features of the claim 1 and its dependent claims.

A further object of the present invention is to provide a grooming unit which can be easily attached to an apparatus according to the invention and which has a simple structure. This object is achieved by the features of independent claims 12, 18 and 22 and their dependent claims.

According to the invention an apparatus is provided which is adapted to receive interchangeable grooming units. Said apparatus comprises a casing and a motor and further attachment means to allow a grooming unit to be releasable attached to the casing. The apparatus further comprises mounting means which allow the grooming units to be driven by the motor and which comprise a shaft with an end portion having a protrusion located eccentrically on the end portion. The mounting means are adapted to enable the grooming unit with accordingly adapted receiving means to carry out a rotational movement and/or a linear movement without the necessity of providing gear arrangements in the receiving means of the grooming unit.

Since no gear arrangements are necessary to enable the grooming units and their accordingly adapted receiving means to carry out different movements, an apparatus can be provided which can be used for different operations such as epilating and depilating body hair or cutting nose hairs, sharpening nails or peeling operations. Further, the apparatus has a simple structure and is space saving. Moreover, the apparatus can be manufactured at low costs.

According to the invention, grooming units are provided which have a simple structure and can be easily attached to an apparatus. This has the advantage that the grooming units can be easily exchanged and do not require additional space.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1A:
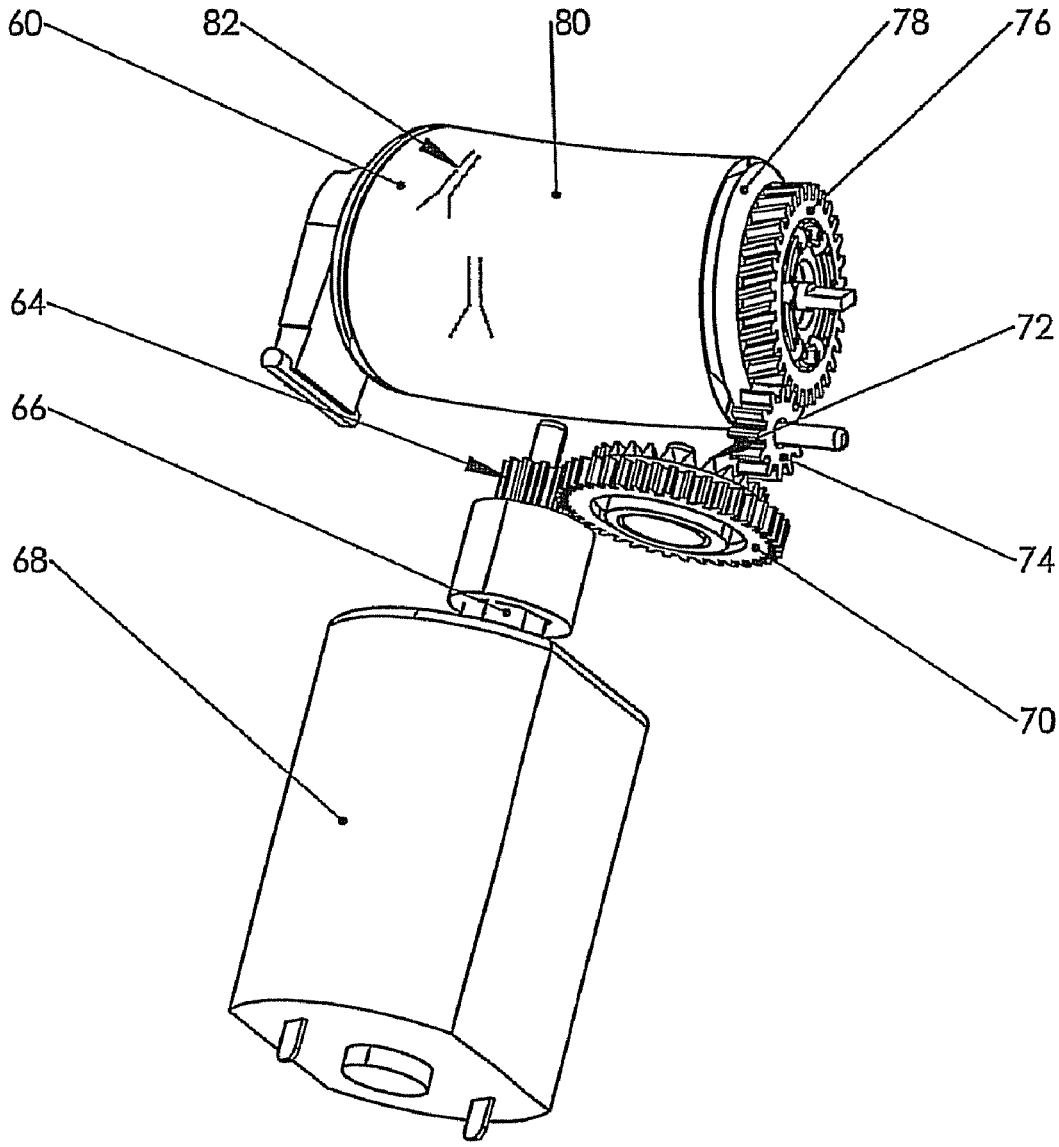
FIG 1A PRIOR ART
FIG. 1A is plan view of a part of a conventional hair remover comprising at one end a depilation means.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

In FIG. 1A a conventional hair remover is disclosed, which comprises an epilating cylinder 60 which is connected to a gear arrangement 62. The gear arrangement 62 comprises a rotary gear 64 which is affixed to one end of an axle 66 of a motor 68. A rotary gear 70 is permanently engaged with the rotary gear 64 and has its axis of rotation parallel to that of the rotary gear 64 and has teeth 72 extending from the surface of the rotary gear 70 facing away from the motor 68. A rotary gear 74 is positioned at a right angle to the rotary gears 64, 70 and permanently engages with the teeth 72 of the rotary gear 70. A rotary gear 76 is affixed to an end of an axle 78 of an epilating head 80. Grippers 82 are formed at the periphery of the epilating head 80. When the axle 66 is driven by the motor 68, the rotary gear 64 is rotated, thereby rotating the rotary gear 70 and the teeth 72. The rotation of the teeth 72 causes the rotary gear 74 to rotate. Further the rotation of the rotary gear 76 causes the axle 78 of the epilating cylinder 60 to rotate, thereby causing grippers 82 of the epilating cylinder to 60 open and close, so as to pluck hairs from a skin of the user.

Figure 1B:
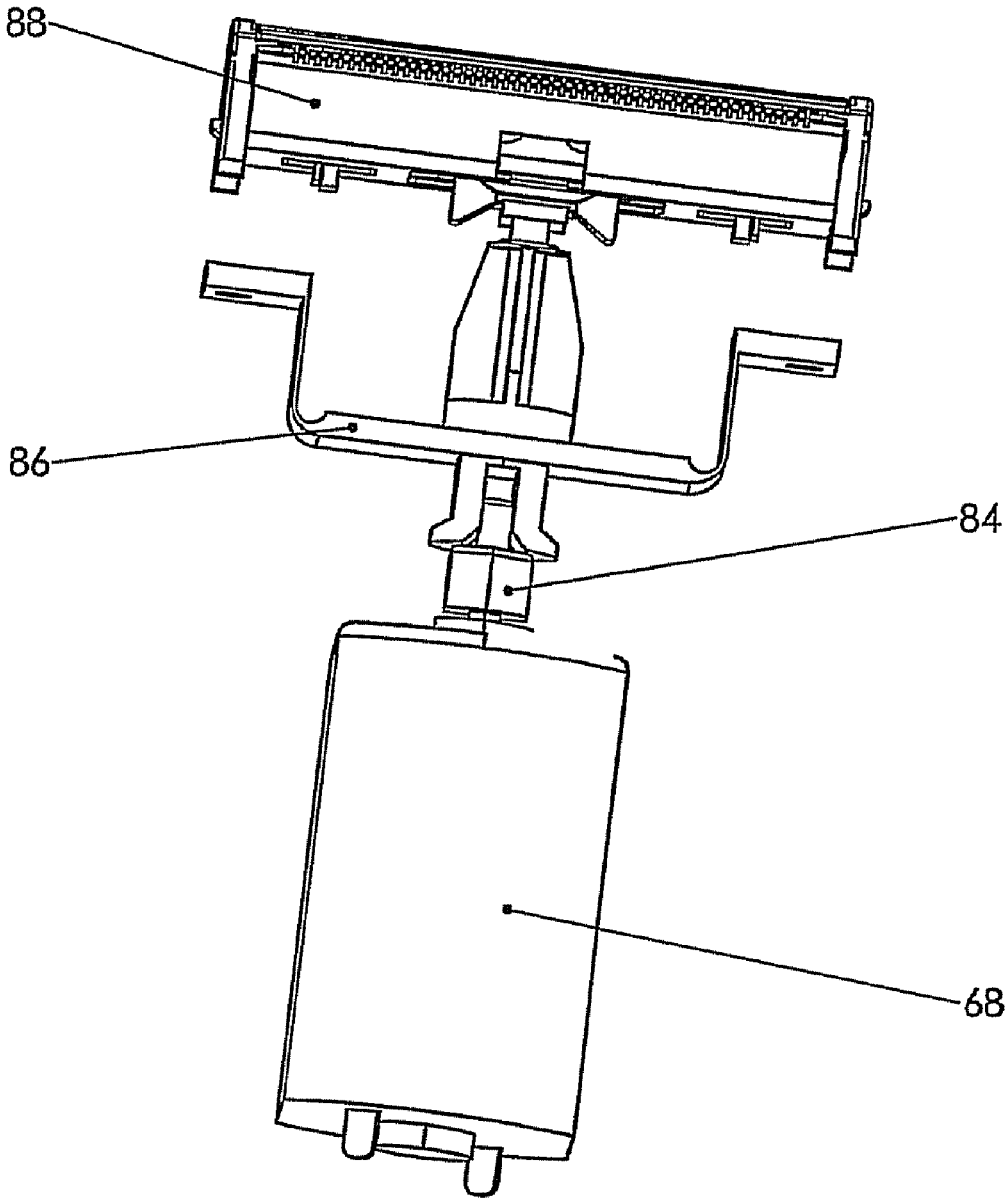
FIG 1B PRIOR ART
FIG. 1B is a plan view of the apparatus according to FIG. 1A wherein the apparatus is provided with a cutting device at the other end.

In FIG. 1B the hair remover is provided with a second axle 84 on the other end which is simultaneously driven by the motor 68 and which causes a shaving element 86 of a depilating head to reciprocate back and forth relative to a fixed element 88. The reciprocating of the shaving element 86 causes the hair extending from the surface of the skin of a user between the shaving element and the fixed element to be cut.

Figure 2:
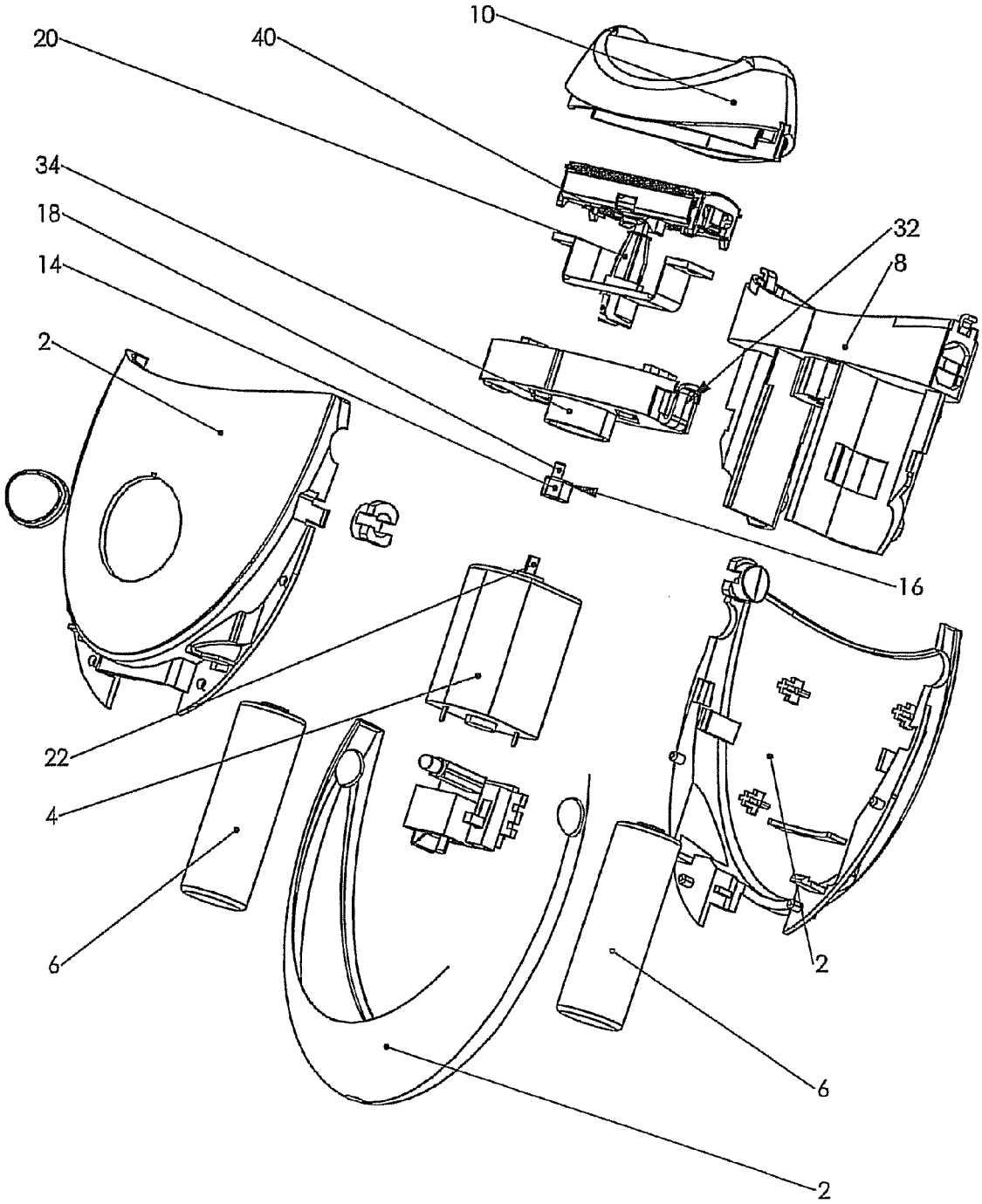
FIG. 2 is a sectional view of an apparatus according to an embodiment of the invention, wherein the apparatus is provided with a shaving means as a grooming unit.
Figure 3:
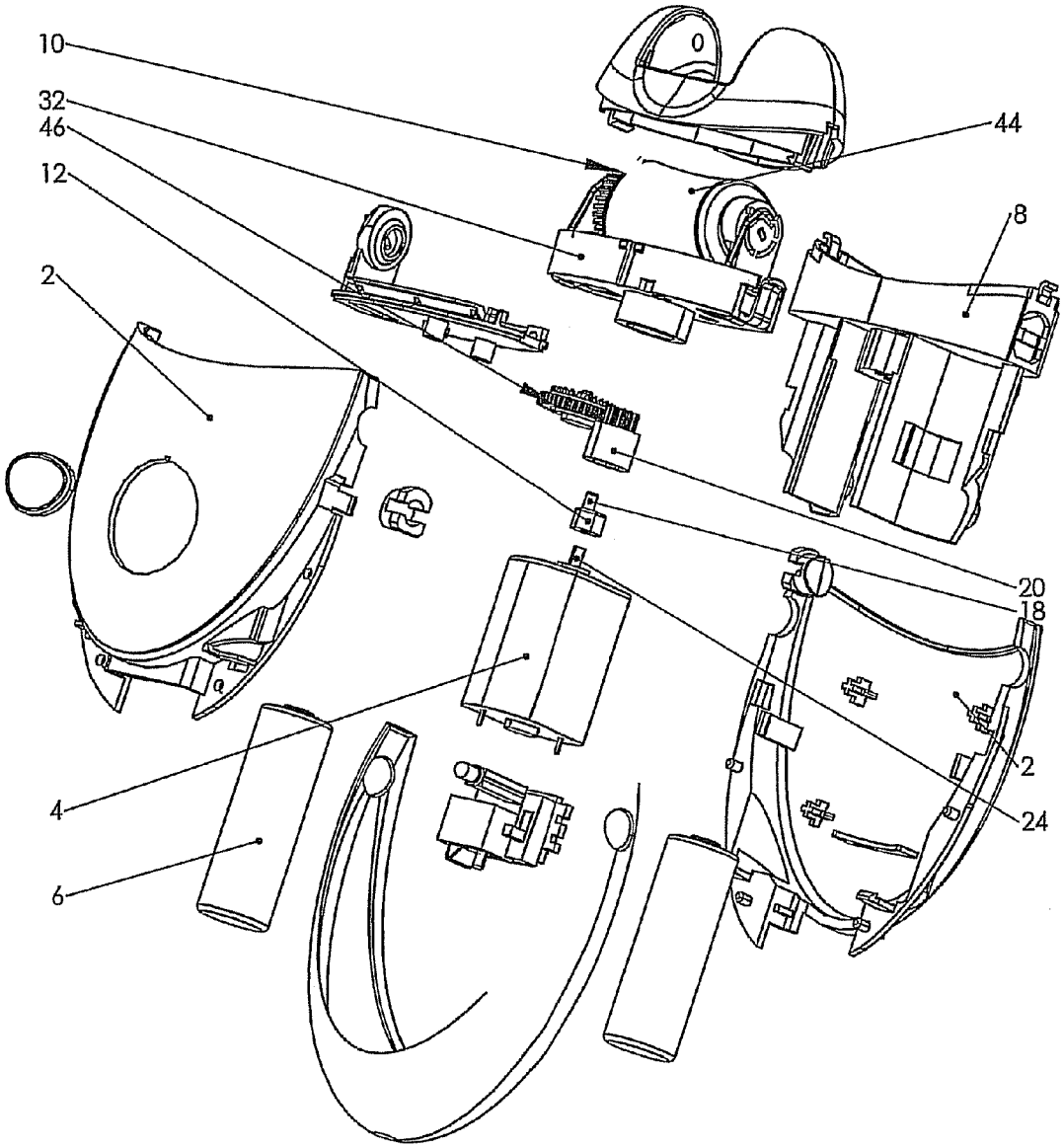
FIG. 3 is a sectional view of a further embodiment of the apparatus according to the invention, wherein the apparatus is provided with an epilation cylinder as a grooming unit.

In contrast thereto, FIGS. 2 and 3 disclose different embodiments of an apparatus according to the invention. The apparatus as disclosed in the figures are provided with different grooming units 10 according to the invention.

The apparatus as disclosed in FIG. 2 comprises a casing 2 in which a motor 4 is arranged. The motor is fed in the present embodiment from two batteries 6 which can be regular or rechargeable. As a further alternative the motor can be provided with at least one adaptor.

Further, an attachment means 8 is provided which is adapted so that a grooming unit 10 can be releasable attached thereto. As can be derived from FIG. 2, the attachment means 8 can comprise a recess 30 or alternatively an opening which is adapted to receive a protrusion 34 of a unit attachment means 32 of the grooming unit 10.

The apparatus 1 further comprises a mounting means 12 which can be connected with a shaft 24 of the motor 4, so that the rotation of the shaft 24 can transmit a rotational movement to the mounting means 12.

Figure 4A:
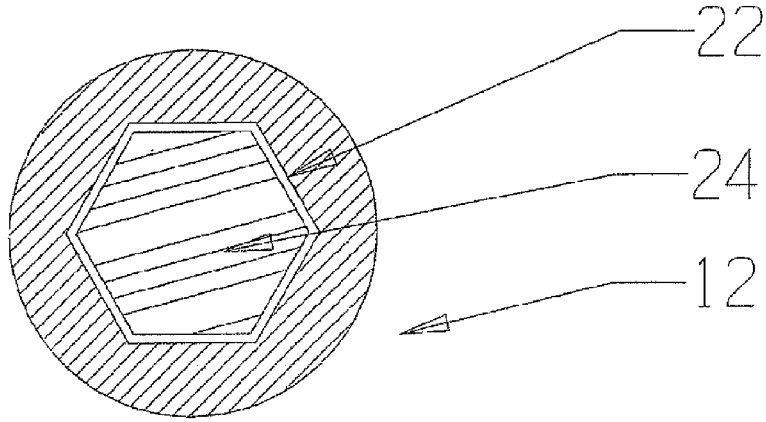
FIGS. 4A-4C are sectional views A-A of FIGS. 2 and 3.
Figure 4B:
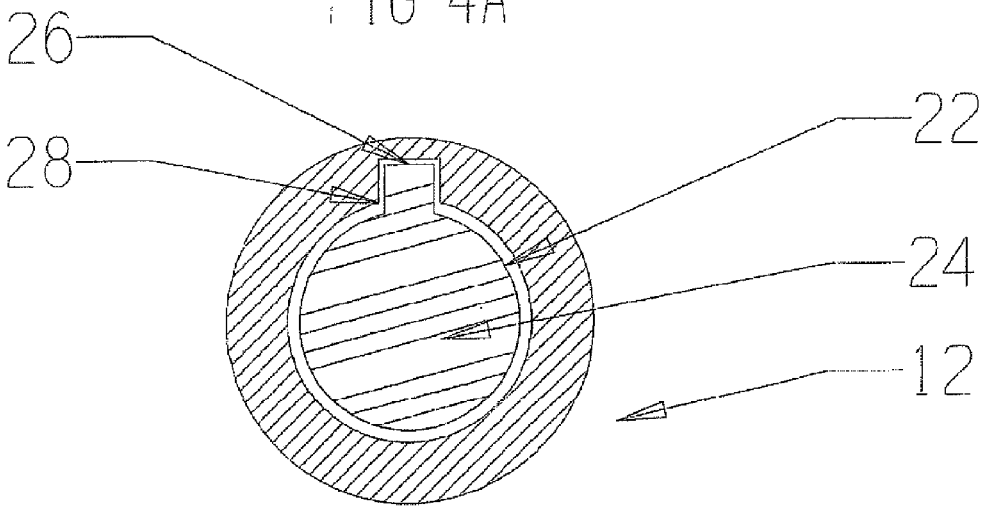
Figure 4C:
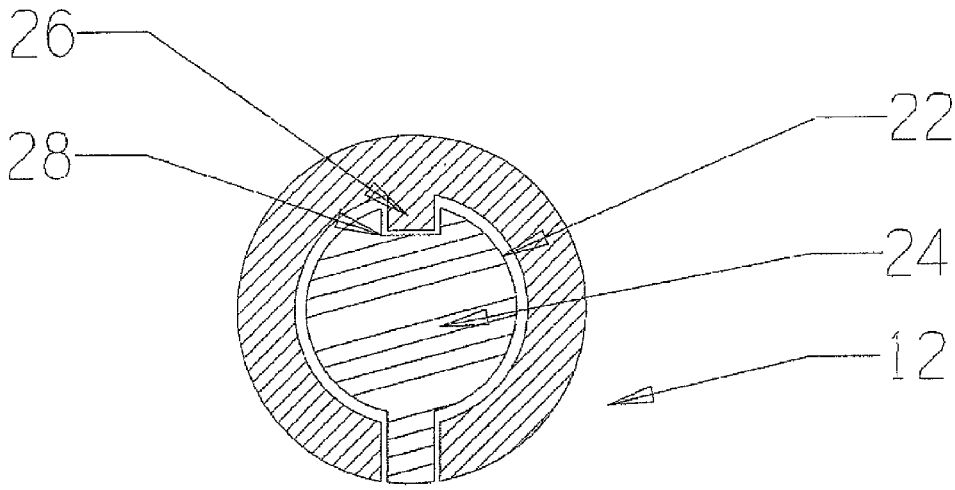

As is shown in FIGS. 4A, 4B and 4C, there are a plurality of possibilities to connect the shaft 24 with a recess 22 of a shaft 14 of the mounting means 12. In FIG. 4A the shaft 24 comprises a polygonal portion which is adapted to fit in a corresponding polygonal portion of the recess 22. Further, in FIG. 4B the shaft 24 can be provided with at least one protrusion 28 and the recess 22 with a corresponding groove 26 in which the protrusion can be inserted. Furthermore, in FIG. 4C the shaft 24 is provided with a groove 26 and a protrusion 28 to be attached to the recess 22 of the mounting means 12 comprising a corresponding protrusion and a corresponding groove. Another possibility is to provide the shaft 24 and the recess 22 with a thread. It is obvious for a man skilled in the art there are many different possibilities known in the art to connect the shaft and the mounting means so that the rotational movement of the shaft 24 can be transmitted to the mounting means 12. The present invention is not limited to the possibilities as shown in FIGS. 4A-4C.

The shaft 14 of the mounting means 12 comprises a protrusion 18 at its end portion 16. The protrusion 18 is located preferably eccentrically on the end portion 16. In this case, a rotation of the shaft 24 of the motor 4 can transmit a rotational movement to the protrusion 18. Since the protrusion 18 is located eccentrically on the end portion 16 the protrusion 18 can execute a linear movement respectively move reciprocating in alternating directions.

Thus a grooming unit 10 can be either connected with the protrusion 18 of the mounting means 12 (see FIG. 2) so that a linear movement can be transmitted to the grooming unit 10 or can be connected with the shaft 14 of the mounting means 12 (see FIG. 3) so that a rotational movement can be transmitted to the grooming unit 10. This has the advantage that a plurality of different grooming units 10 carrying out a linear and/or a rotational movement can be releasably attached to the mounting means.

In FIG. 2 a depilating means 40 is provided as a grooming unit 10. Said depilating means 40 comprises an outer cutter and a fixed cutter, wherein the outer cutter is adapted to perform a reciprocating motion in alternate directions relative to the fixed cutter. The cutting means further comprises a supporting structure which is adapted to engage with the protrusion 18 of the mounting means 12. Thus, when the protrusion 18 located eccentrically on the end portion 16 of the mounting means 12 rotates it results in a reciprocating motion of the supporting structure and the outer cutter of the cutting device.

Body hairs that have entered a space between the teeth of the outer cutter and the teeth of the inner cutter are then cut off by the linear oscillating motion of the outer cutter.

On the other hand the depilating means disclosed in FIG. 2 can be exchanged by an epilating means as disclosed in FIG. 3 which shows an alternative grooming unit 10.

The grooming unit 10 comprises an epilating cylinder 44 for plucking hair and a gear arrangement 46 for driving the epilating cylinder 44.

Further, the grooming unit 10 comprises a unit attachment means 32 which is adapted to matingly fit with the attachment means 8 of the apparatus 1. As shown in FIG. 3, the unit attachment means 32 comprises a protrusion 34 which can be releasably attached to a corresponding recess 30 of the attachment means 8.

Furthermore, the grooming unit 10 is provided with receiving means 20 which allow the grooming unit 10 to be driven by the apparatus 1. The receiving means 20 comprises a recess 38 for receiving the shaft 14 of the mounting means 12, wherein the receiving means 20 and the mounting means 12 are adapted, so that a rotational movement of the mounting means 12 can be transmitted to the receiving means 20. Since the receiving means 20 is also associated with the epilation means, the circular motion of the receiving means 32 can drive a gear arrangement 46 of the epilating means thereby enabling the grooming unit 10 to pluck hair.

Although a few embodiments of the present invention have been shown and described, it would be appreciated by those skilled in the art that changes may be made in this embodiment without departing from the principles and spirit of the invention, the scope of which is defined in the claims and their equivalents.

The invention claimed is:

1. An apparatus for receiving operationally powering interchangeable grooming units, the apparatus comprising:

a casing releasably attaching to any one of the grooming units, a motor, attachment means for allowing the grooming units to be releasably attached to the casing; and mounting means for allowing the grooming units to be driven by the motor, the mounting means comprising a shaft having a substantially cylindrical side surface and a substantially circular end surface, the end surface having a protrusion extending radially outward from the end surface and a groove located diametrically opposite the protrusion; the shaft is inserted into a recess of the mounting means; wherein the mounting means has a complementary cylindrical shape to that of the shaft; wherein the recess of the mounting means comprises a slot extending therethrough for mating with the protrusion of the shaft and a diametrically opposed protrusion for mating with the groove of the shaft;

wherein the mounting means are adapted to enable the grooming units with accordingly adapted receiving means to carry out a rotational movement and a linear movement in the receiving means of the grooming unit, without gear arrangements in the mounting means, and wherein the mounting means are disposed in the casing and are used to mount any one of the grooming units releasably attached to the casing.

2. The apparatus as claimed in claim 1, wherein the shaft of the mounting means is provided with a recess for receiving a shaft of the motor and wherein the recess and the shaft of the motor are adapted to be connected, so that a rotational movement of the motor can be transmitted to the mounting means.

3. The apparatus as claimed in claim 2, wherein the shaft of the motor comprises a polygonal portion which is adapted to fit in a corresponding polygonal portion of the recess, so that the shaft of the motor can transmit a rotational movement to the mounting means.

4. The apparatus as claimed in claim 2, wherein the recess or the shaft of the motor is provided with at least one protrusion which can be inserted in a corresponding groove of the shaft of the motor and the recess, respectively.

5. The apparatus as claimed in claim 2, wherein the shaft of the motor and the recess are connected by a screw connection, wherein the recess is provided with an inside thread and the shaft of the motor is provided with a corresponding outside thread.

6. The apparatus as claimed in claim 1, wherein the attachment means comprises a recess or an opening to which a corresponding unit attachment means of a grooming unit can be attached.

7. The apparatus as claimed in claim 6, wherein the attachment means and unit attachment means are adapted to matingly fit with each other.

8. The apparatus as claimed in claim 1, wherein the mounting means are adapted to be connected to a receiving means of a grooming unit to transmit a rotational movement of the motor to the receiving means.

9. The apparatus as claimed in claim 8, wherein the shaft of the mounting means is adapted to receive the receiving means of the grooming unit, so that a rotational movement can be transmitted to the mounting means thereby causing the grooming unit to operate.

10. The apparatus as claimed in claim 9, wherein the protrusion located eccentrically of the mounting means is adapted to receive the receiving means of a grooming unit, so that a linear movement of the mounting means can be transmitted to the receiving means thereby causing the grooming unit to operate.

11. An apparatus as claimed in claim 1, wherein the motor is fed from at least one battery which is preferably regular or rechargeable.

12. A grooming unit for operational use with the apparatus as claimed in claim 1, the grooming unit comprising:

unit attachment means for allowing the grooming unit to be attached to the apparatus, the unit attachment means adapted to matingly fit with the attachment means of the apparatus; and receiving means adapted to receive the mounting means of the apparatus such that the receiving means is driven by the motion transmitted by the mounting means of the apparatus thereby causing the grooming unit to operate.

13. The grooming unit according to claim 12, wherein the unit attachment means comprises a protrusion which can be releasably attached to a corresponding recess or opening of the attachment means of the apparatus.

14. The grooming unit according to claim 12, wherein the receiving means comprises a recess to receive the protrusion of the mounting means, so that a linear movement of the mounting means can be transmitted to the receiving means.

15. The grooming unit according to claim 12, wherein the receiving means comprises a recess to receive an outer portion of the shaft of the mounting means so that a rotational movement of the mounting means can be transmitted to the receiving means.

16. The grooming unit of claim 12, wherein the grooming unit is a nail sharpener.

17. The grooming unit of claim 12, wherein the grooming unit is a cutter for nose hairs.

18. A grooming unit for removing body hair by depilation, the grooming unit being adapted for operational use with the apparatus according to claim 1, the grooming unit comprising:

unit attachment means matingly fitting with the attachment means of the apparatus;

depilation means for cutting body hair; and receiving means for allowing the grooming unit to be driven by the apparatus, the receiving means being associated with the depilation means and with the mounting means of the apparatus such that the receiving means can provide a linear motion in cooperation with the protrusion of the mounting means of the apparatus, thereby enabling the depilation means to cut hair.

19. The grooming unit according to claim 18, wherein the unit attachment means comprises a protrusion which can be releasably attached to a corresponding recess or opening of the attachment means of the apparatus.

20. The grooming unit according to claim 18, wherein the receiving means comprises a recess to receive the protrusion of the mounting means, so that a linear movement of the mounting means can be transmitted to the receiving means.

21. The grooming unit according to claim 18, wherein the depilation means comprises an outer cutter and a fixed cutter, wherein the outer cutter is connected with the receiving means, so that a linear movement can be transmitted to the outer cutter.

22. A grooming unit for removing body hair by epilation, the grooming unit being adapted for operational use with the apparatus according to claim 1, the grooming unit comprising:

unit attachment means matingly fitting with the attachment means of the apparatus;

epilation means comprising an epilating cylinder for plucking hair and a gear arrangement for driving the epilating cylinder; and receiving means for allowing the grooming unit to be driven by the apparatus, the receiving means being associated with the epilation means and with the mounting means of the apparatus such that when the receiving means is driven by the circular motion transmitted by the end portion of the shaft of the mounting means of the apparatus, the gear arrangement of the epilation means is driven by the receiving means, thereby enabling the grooming unit to pluck hair.

23. The grooming unit according to claim 22, wherein the unit attachment means comprises a protrusion which can be releasably attached to a corresponding recess or opening of the attachment means of the apparatus.

24. The grooming unit according to claim 22, wherein the receiving means comprises a recess to receive the shaft of the mounting means, wherein the receiving means and the mounting means are adapted, so that a rotational movement of the mounting means can be transmitted to the receiving means.

25. A grooming kit comprising:

the apparatus according claim 1; and at least one grooming unit comprising:

unit attachment means for allowing the grooming unit to be attached to the apparatus, the unit attachment means adapted to matingly fit with the attachment means of the apparatus; and receiving means adapted to receive the mounting means of the apparatus such that the receiving means is driven by the motion transmitted by the mounting means of the apparatus thereby causing the grooming unit to operate.

26. A hair removing apparatus, comprising:

a depilation unit, comprising:

a shaving unit having blades shaving off hair;

a first receiving unit connecting the depilation unit to a motor to drive the shaving unit to remove hair;

an epilation unit, comprising:

an epilating cylinder having grippers opening and closing on hair to pluck hair;

a second receiving unit connecting the epilation unit to the motor to drive the epilation unit to remove hair;

a gear arrangement connecting the second receiving unit to the epilating cylinder; and a casing, comprising:

the motor driving the hair removing apparatus;

attachment means releasably attachable to both the depilation unit and the epilation unit; and mounting means individually mounting both the epilation unit and the shaving unit to the casing and individually connecting both the epilation unit and the shaving unit to the motor to transmit motion of the motor to the epilation unit and the shaving unit via a shaft having a substantially cylindrical side surface and a substantially circular end surface, the end surface having a protrusion extending radially outward from the end surface and a groove located diametrically opposite the protrusion;

the shaft is inserted into a recess of the mounting means; wherein the mounting means has a complementary cylindrical shape to that of the shaft; wherein the recess of the mounting means comprises a slot extending therethrough for mating with the protrusion of the shaft and a diametrically opposed protrusion for mating with the groove of the shaft;

wherein the shaft is disposed in the mounting means and is used to mount both the epilation unit and the shaving unit.

27. The hair removing apparatus of claim 26, wherein the casing does not include gear arrangements translating the motion of the motor to either the depilation unit or the epilation unit.

* * * * *